US010843357B2

(12) United States Patent
Jang

(10) Patent No.: US 10,843,357 B2
(45) Date of Patent: Nov. 24, 2020

(54) RAZOR ASSEMBLY

(71) Applicant: DORCO CO., LTD., Seoul (KR)

(72) Inventor: Sejun Jang, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/193,852

(22) Filed: Nov. 16, 2018

(65) Prior Publication Data

US 2019/0152078 A1 May 23, 2019

(30) Foreign Application Priority Data

Nov. 21, 2017 (KR) ..... 10-2017-0155826

(51) Int. Cl.
*B26B 21/52* (2006.01)
*B26B 21/40* (2006.01)
*B26B 21/22* (2006.01)

(52) U.S. Cl.
CPC ..... *B26B 21/521* (2013.01); *B26B 21/225* (2013.01); *B26B 21/4012* (2013.01)

(58) Field of Classification Search
CPC ..... B26B 21/06; B26B 21/14; B26B 21/22; B26B 21/225; B26B 21/40; B26B 21/4012; B26B 21/52; B26B 21/521
USPC ..... 30/47–51, 526, 527
See application file for complete search history.

(56) References Cited

U.S. PATENT DOCUMENTS 947,010 A * 1/1910 Woods ..... B26B 21/18 30/527
947,209 A * 1/1910 Woods ..... B26B 21/18 30/527
1,633,139 A * 6/1927 Staats-Oels ..... B26B 21/22 30/50

(Continued)

FOREIGN PATENT DOCUMENTS

EP 0885697 12/1998
EP 1136197 9/2001

(Continued)

OTHER PUBLICATIONS

European Patent Office Application Serial No. 18207496.3, Search Report dated Feb. 12, 2019, 9 pages.

(Continued)

*Primary Examiner* — Jason Daniel Prone
(74) *Attorney, Agent, or Firm* — Lee, Hong, Degerman, Kang & Waimey

(57) ABSTRACT

A razor handle assembly includes a connector which is detachably coupled to a razor cartridge; a razor handle which is elongated along a longitudinal axis and coupled to the connector such that the connector is capable of pivoting about a rotation axis perpendicular to both the longitudinal axis and a transverse axis along which the razor cartridge is elongated, the transverse axis being perpendicular to the longitudinal axis; and an elastic member having a first end engaged with a first fixing portion formed in the connector and a second end engaged with a second fixing portion formed in the razor handle. When the connector pivots about (Continued)

the rotation axis with respect to the razor handle, the elastic member is deformed to provide a restoring force that causes the connector to return to a neutral position at which the transverse axis is perpendicular to the longitudinal axis.

9 Claims, 13 Drawing Sheets

(56) References Cited

U.S. PATENT DOCUMENTS 1,694,337 A * 12/1928 Oberheim ..... B26B 21/22 30/50
2,060,445 A * 11/1936 Ryley ..... B26B 21/52 30/527
2,678,490 A * 5/1954 Winslow ..... B26B 21/52 30/527
3,740,841 A * 6/1973 Risher ..... B26B 21/16 30/57
3,935,639 A * 2/1976 Terry ..... B26B 21/225 30/47
4,152,828 A * 5/1979 Lund ..... B26B 21/225 30/529
4,347,663 A * 9/1982 Ullmo ..... B26B 21/225 30/47
4,475,286 A * 10/1984 Saito ..... B26B 21/225 30/50
4,688,329 A * 8/1987 Oord ..... B26B 19/146 30/527
4,879,811 A * 11/1989 Cooney ..... B26B 21/52 30/527
5,029,391 A 7/1991 Althaus et al.
5,038,472 A * 8/1991 Iderosa ..... B26B 21/521 30/527
5,050,301 A * 9/1991 Apprille, Jr. ..... B26B 21/52 30/529
5,070,614 A * 12/1991 Hardin ..... B26B 21/521 30/527
5,167,069 A * 12/1992 Quinn ..... B26B 21/523 30/527
5,206,994 A * 5/1993 Lin ..... B26B 21/523 30/47
5,206,995 A * 5/1993 Min ..... B26B 21/52 30/527
5,333,382 A * 8/1994 Buchbinder ..... B26B 21/56 30/47
5,526,568 A * 6/1996 Copelan ..... B26B 21/52 30/531
5,560,106 A * 10/1996 Armbruster ..... B26B 21/225 30/526
5,687,485 A 11/1997 Shurtleff et al.
5,761,814 A 6/1998 Anderson et al.
5,787,594 A * 8/1998 Estrada ..... B26B 21/52 30/527
5,956,848 A 9/1999 Tseng et al.
5,956,851 A 9/1999 Apprille et al.
6,041,926 A 3/2000 Petricca et al.
6,052,903 A 4/2000 Metcalf et al.
6,185,822 B1 2/2001 Tseng et al.
6,212,777 B1 4/2001 Gilder et al.
6,223,442 B1 * 5/2001 Pina ..... B26B 21/521 30/50
6,442,839 B1 9/2002 Tseng et al.
6,516,518 B1 2/2003 Garraway et al.
6,526,660 B1 * 3/2003 MacNeil ..... B26B 21/40 30/50
6,612,040 B2 9/2003 Gilder
6,615,498 B1 * 9/2003 King ..... B26B 21/521 30/527
6,684,513 B1 2/2004 Clipstone et al.
7,093,363 B1 * 8/2006 Kuo ..... B26B 21/40 30/47
7,140,116 B2 11/2006 Coffin
7,647,699 B1 * 1/2010 Geile ..... B26B 19/14 30/50
7,721,451 B2 * 5/2010 Psimadas ..... B26B 21/40 30/50
7,797,834 B2 * 9/2010 Steunenberg ..... B26B 21/38 30/50
7,937,837 B2 * 5/2011 Psimadas ..... B26B 21/52 30/34.1
8,033,027 B2 * 10/2011 Leventhal ..... B26B 19/10 30/526
8,112,892 B2 * 2/2012 Haczek ..... B26B 19/3873 30/50
8,205,343 B2 * 6/2012 Winter ..... B26B 21/40 30/527
8,745,882 B2 * 6/2014 Murgida ..... B26B 21/521 30/527
8,745,883 B2 * 6/2014 Murgida ..... B26B 21/521 30/527
8,819,946 B2 * 9/2014 Yamasaki ..... B26B 19/048 30/527
8,898,909 B2 * 12/2014 Schmitt ..... B26B 19/048 30/527
8,938,885 B2 1/2015 Stevens
8,978,258 B2 * 3/2015 Patel ..... B26B 21/52 30/527
9,032,631 B2 * 5/2015 Christie ..... B26B 21/521 30/527
9,469,038 B2 * 10/2016 Iaccarino ..... B26B 21/521
9,993,931 B1 * 6/2018 Zucker ..... B26B 21/521
2002/0104223 A1 * 8/2002 Oldroyd ..... B26B 21/521 30/527
2003/0177648 A1 * 9/2003 Zeiter ..... B26B 21/523 30/526
2003/0213130 A1 * 11/2003 Motta ..... B26B 21/225 30/50
2005/0034314 A1 * 2/2005 Cuisinier ..... B26B 21/222 30/527
2006/0283019 A1 * 12/2006 Oh ..... B26B 19/3853 30/47
2010/0313426 A1 * 12/2010 Royle ..... B26B 21/521 30/57
2011/0035950 A1 * 2/2011 Royle ..... B26B 21/521 30/527
2011/0088268 A1 * 4/2011 Marut ..... B26B 21/523 30/526
2011/0277326 A1 * 11/2011 Bodet ..... B26B 21/52 30/527
2012/0110855 A1 * 5/2012 Allen, Sr. ..... B26B 19/14 30/526
2012/0246947 A1 * 10/2012 Fang ..... B26B 21/225 30/526
2012/0291295 A1 * 11/2012 Braun ..... B26B 21/521 30/531
2013/0081290 A1 * 4/2013 Murgida ..... B26B 21/521 30/527
2013/0091709 A1 * 4/2013 Shimizu ..... B26B 19/02 30/47
2013/0291391 A1 11/2013 Stevens
2014/0109735 A1 * 4/2014 Shepperson ..... B26B 21/521 30/527
2014/0190013 A1 * 7/2014 Coviello ..... B26B 21/523 30/47
2016/0144520 A1 * 5/2016 Lee ..... B26B 21/521 30/51
2017/0173806 A1 * 6/2017 Lee ..... B26B 21/521
2017/0282392 A1 10/2017 Maimone et al.
2019/0152079 A1 * 5/2019 Chang ..... B26B 21/521
2019/0255721 A1 * 8/2019 Psimadas ..... B26B 21/521

FOREIGN PATENT DOCUMENTS

EP 3486049 A1 * 5/2019 ..... B26B 1/225
JP 04022389 1/1992
JP 11300065 11/1999
JP 2000300871 10/2000

(56) References Cited

FOREIGN PATENT DOCUMENTS

| | | |
|---|---|---|
| KR | 1020140050220 | 4/2014 |
| WO | 2004076136 | 9/2004 |
| WO | 2012129720 | 10/2012 |

OTHER PUBLICATIONS

Korean Intellectual Property Office Application No. 10-2017-0155826, Notice of Allowance dated Aug. 24, 2018, 1 pages.

* cited by examiner

RAZOR ASSEMBLY

CROSS-REFERENCE TO RELATED APPLICATIONS

Pursuant to 35 U.S.C. § 119(a), this application claims the benefit of earlier filing date and right of priority to Korean Patent Application No. 10-2017-0155826, filed on Nov. 21, 2017, the contents of which are hereby incorporated by reference herein in its entirety.

BACKGROUND

1. Field

The present disclosure relates to a razor assembly, and more particularly, to a razor assembly that can pivot about a rotation axis perpendicular to the alignment direction of one or more razor blades.

2. Description of the Related Art

A conventional razor assembly, commonly known as a wet razor, includes a razor cartridge and a razor handle. The razor cartridge generally includes one or more blades disposed between a rear side of a guard bar and a front side of a cap. The razor cartridge is rotatably installed on the razor handle so that it can pivot between a neutral position and a pivotal position with respect to the razor handle during use of the razor assembly. This pivoting motion is basically based on a rotation axis parallel to a direction in which the razor blades are disposed in the razor cartridge.

The pivoting motion of the razor cartridge between the neutral position and the pivotal position with respect to the razor handle plays an important role because it allows the razor cartridge and related blades to keep contacting the cutting surface.

During normal shaving, the razor cartridge may pivot with respect to the razor handle in the direction of the pivotal position as it is moved away from the cutting surface by a certain force. The force may include a force caused by the cutting surface passing through the guard bar and a, force required when the blades cut hair. In order to compensate for the characteristics of the cartridge that pivots away from the cutting surface, the razor usually uses a biasing member such as a spring plunger. The biasing member acts to keep the razor cartridge in contact with the cutting surface by applying force to the razor cartridge in the direction of the neutral position.

A multi-axis rotary razor may enable razor blades to smoothly contact the profile of various users' skin by providing not only the function of pivoting about a first axis but also the function of pivoting about a second axis perpendicular to the first axis.

However, the razor structure may become complicated in order to provide various movements of such a multi-axis rotary razor, or a proper pivoting motion may not be provided due to a structural weakness. Therefore, there is a need to develop a novel razor assembly capable of stably providing a multi-axis pivoting motion with a simpler structure.

SUMMARY

Aspects of the present disclosure provide a razor assembly which reliably and stably provides a pivoting motion about a second axis perpendicular to a first axis that is parallel to the alignment direction of one or more razor blades.

Aspects of the present disclosure also provide a razor assembly which provides a pivoting motion about the second axis with a simpler structure and is not deformed even when used for a long time.

Aspects of the present disclosure also provide a pivoting motion about the second axis through extension or torsion of an elastic member itself.

However, aspects of the present disclosure are not restricted to the one set forth herein. The above and other aspects of the present disclosure will become more apparent to one of ordinary skill in the art to which the present disclosure pertains by referencing the detailed description of the present disclosure given below.

According to an aspect of the present disclosure, there is provided a razor assembly including: one or more razor blades, each having a cutting edge; a housing which accommodates the razor blades in a transverse direction perpendicular to a shaving direction; a connector which is detachably coupled to the housing at the back of the housing; a razor handle which is coupled to the connector such that the connector can pivot about a rotation axis perpendicular to the transverse direction; and an elastic member which has a first end engaged with a first fixing portion formed in the connector and a second end engaged with a second fixing portion formed in the razor handle, wherein when the connector pivots about the rotation axis with respect to the razor handle, the elastic member is deformed to provide a restoring force that causes the connector to return to a neutral position.

According to another aspect of the present disclosure, there is provided a razor handle assembly including: a connector which is detachably coupled to a razor cartridge at the back of the razor cartridge; a razor handle which is coupled to the connector such that the connector can pivot about a rotation axis perpendicular to a transverse direction; and an elastic member which has a first end engaged with a first fixing portion formed in the connector and a second end engaged with a second fixing portion formed in the razor handle, wherein when the connector pivots about the rotation axis with respect to the razor handle, the elastic member is deformed to provide a restoring force that causes the connector to return to a neutral position.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1A:
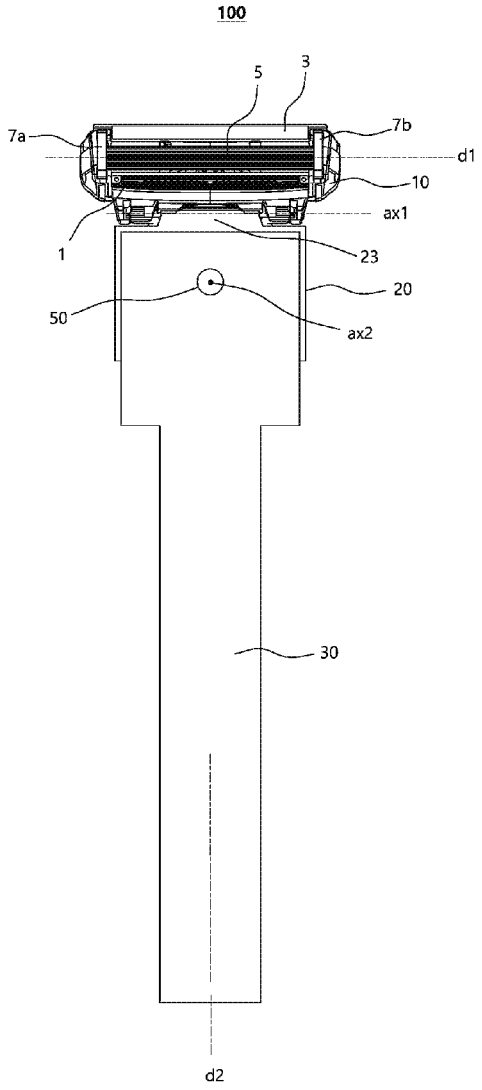
FIG. 1A is a plan view of a razor assembly according to a first embodiment as viewed from the front of a razor handle.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the embodiments set forth herein. Rather, these embodiments are provided so that this disclosure will be thorough and complete and will fully convey the concept of the invention to those skilled in the art, and the present disclosure will only be defined by the appended claims. Like reference numerals refer to like elements throughout the specification.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated elements, but do not preclude the presence or addition of one or more other elements.

Hereinafter, embodiments of the present disclosure will be described in detail with reference to the accompanying drawings.

Figure 1B:
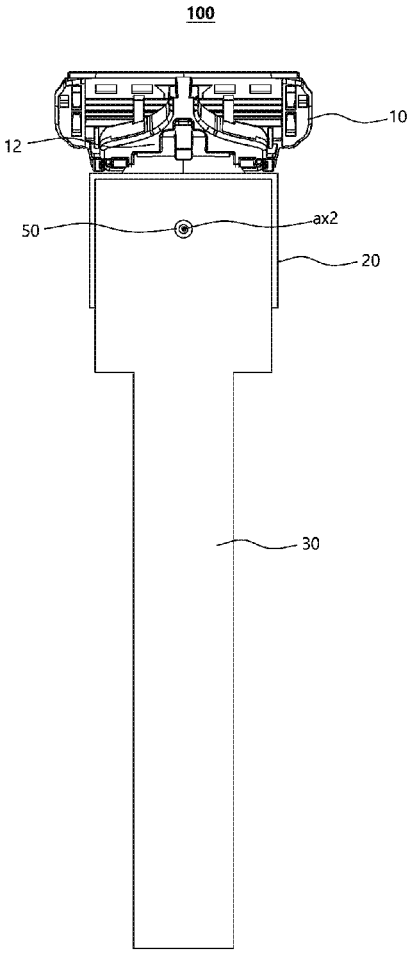
FIG. 1B is a plan view of the razor assembly of FIG. 1A as viewed from the back of razor handle.
Figure 1C:
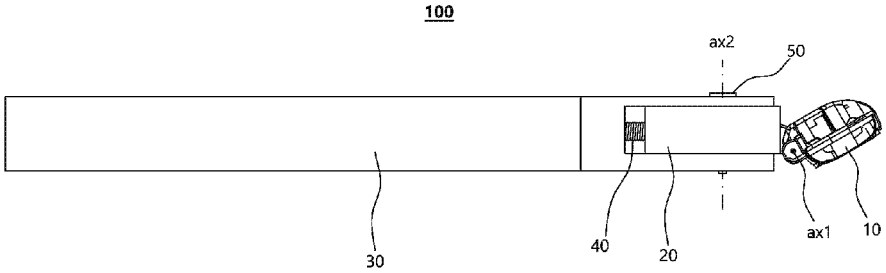
FIG. 1C is a right side view of the razor assembly of FIG. 1A as viewed from a right side of the razor handle.

FIG. 1A is a plan view of a razor assembly 100 according to a first embodiment as viewed from the front of a razor handle 30 (where the front of a blade housing 10 is visible), FIG. 1B is a plan view of the razor assembly 100 as viewed from the back, and FIG. 1C is a right side view of the razor assembly 100 as viewed from a right side.

The razor assembly 100 according to the first embodiment may include a razor cartridge including a razor blade 5 and the blade housing 10, a connector 20, and the razor handle 30. The razor blade 5 may have a cutting edge at a first end, and a second end of the razor blade 5 may be seated in a seating portion provided in the blade housing 10. Here, one razor blade 5 or two or more razor blades 5 may be provided, and a direction in which the razor blade (or blades) 5 is accommodated in the blade housing 10 is a transverse direction d1 perpendicular to a shaving direction.

A pair of clips 7*a* and 7*b* for fixing both sides of the first end of the razor blade 5 to the blade housing 10 may be provided in order to prevent the razor blade 5 from being separated from the blade housing 10. The pair of clips 7*a* and 7*b* cover both sides of the razor blade 5 and pass through one or more through holes formed near both ends of the blade housing 10 so as to be bent on the back 12 of the blade housing 10.

In addition, a guard bar 1 may be provided parallel to the razor blade 5 in front of a position where the razor blade 5 is accommodated in the blade housing 10, and a lubrication band 3 may be provided parallel to the razor blade 5 behind the above position. The guard bar 1 makes a user's hair erect in a direction perpendicular to the shaving direction in order to facilitate cutting of the razor blade 5, and the lubrication band 3 smoothens the rough skin after the cutting.

The connector 20 is detachably coupled to the blade housing 10 at the back 12 of the blade housing 10. Here, the blade housing 10 may pivot about a first axis ax1 parallel to the transverse direction d1, in which the razor blade 5 is accommodated, with respect to an end of the connector 20. Alternatively, the blade housing 10 may be fixed to a connection portion 23 of the connector 20, and the connection portion 23 may pivot about the first axis ax1 with respect to a body of the connector 20.

The connector 20 is also coupled to the razor handle 30 such that it can pivot about a second axis ax2 perpendicular to the transverse direction d1. The rotation axis, that is, the second axis ax2 is formed in a direction perpendicular to both the transverse direction d1 and a longitudinal direction d2 of the razor handle 30. This coupling is accomplished by a fastener 50 that penetrates both the connector 20 and the razor handle 30 at the position of the second axis ax2. The fastener 50 may be embodied as a pin. However, the present disclosure is not limited to this case, and the fastener 50 may also be a shaft-type structure that enables pivoting of the connector 20 and the razor handle 30.

Figure 2A:
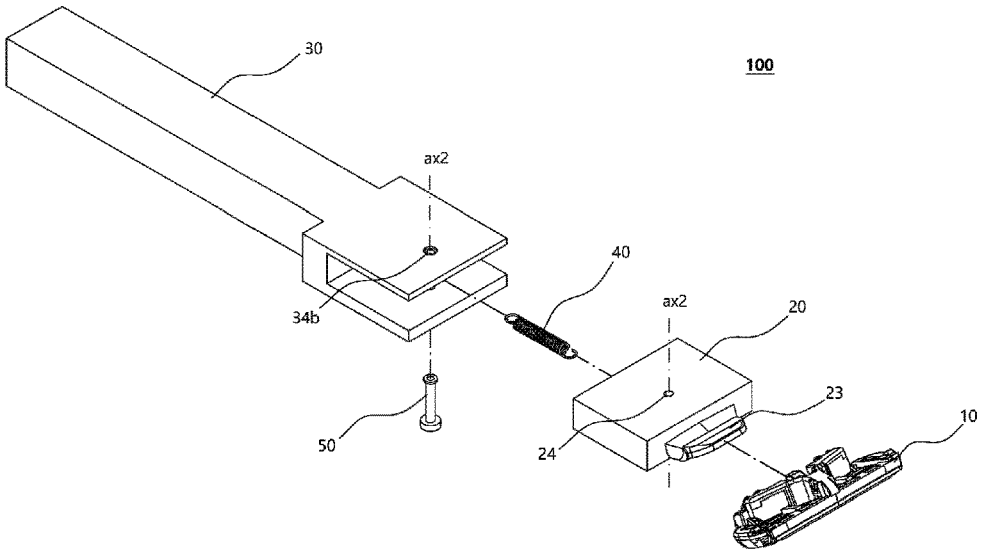
FIGS. 2A and 2B are exploded perspective views of the razor assembly of FIG. 1A as viewed from different directions.
Figure 2B:
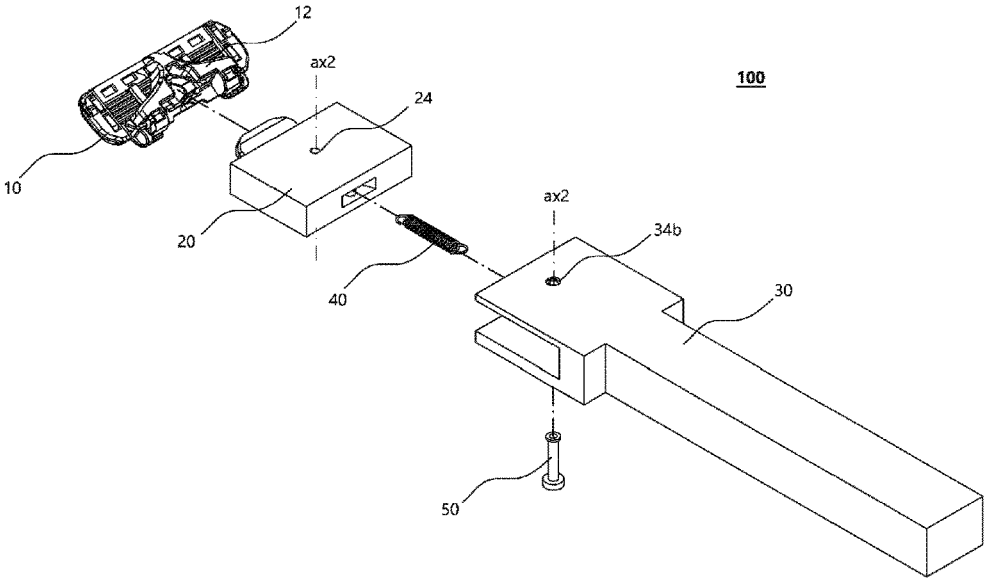
Figure 2C:
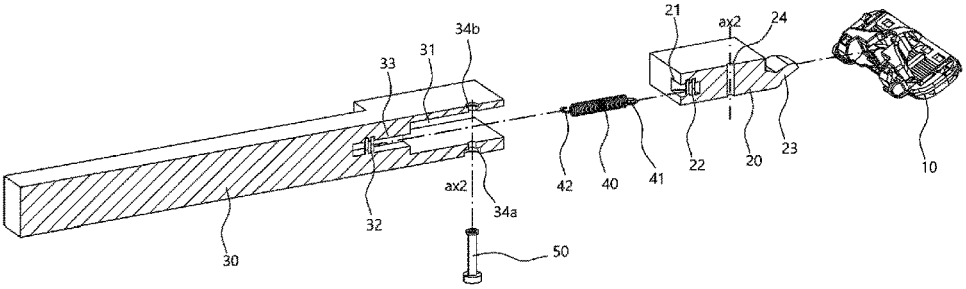
FIG. 2C is a longitudinal sectional view of a connector and the razor handle taken along a longitudinal direction in the exploded perspective view of FIG. 2A.

FIGS. 2A and 2B are exploded perspective views of the razor assembly 100 of FIG. 1A as viewed from different directions, and FIG. 2C is a longitudinal sectional view of the connector 20 and the razor handle 30 taken along the longitudinal direction in the exploded perspective view of the razor assembly 100.

Referring to FIGS. 2A through 2C, the connector 20 and the razor handle 30 are basically coupled by the fastener 50 such that they can pivot relative to each other. The razor handle 30 includes a connector accommodating groove 31 covering at least a part of each of front and rear surfaces of the connector 20. After the body of the connector 20 is placed in the connector accommodating groove 31 of the razor handle 30, the fastener 50 is inserted into a through hole 24 of the connector 20 and through holes 34*a* and 34*b* of the razor handle 30 along the second axis ax2.

In addition, both ends 41 and 42 of an elastic member 40 are respectively engaged with the connector 20 and the razor handle 30 so as to provide a restoring force when the connector 20 pivots about the second axis ax2 with respect to the razor handle 30. Thus, when the connector 20 pivots about the second axis ax2 with respect to the razor handle 30, the elastic member 40 is linearly deformed to elongate in a lengthwise direction, thereby providing the restoring force. The elastic member 40 may be embodied as, for example, a coil spring.

An elastic member accommodating groove 21 is formed at an opposite end of the connector 20 from the connection portion 23, and a first fixing portion 22 for engaging the end 41 of the elastic member 40 is provided in the elastic member accommodating groove 21. Likewise, an elastic member accommodating groove 33 is formed on an inner side of the connector accommodating groove 31 of the razor handle 30, and a second fixing portion 32 for engaging the other end 42 of the elastic member 40 is provided in the elastic member accommodating groove 33. For example, the first and second fixing portions 22 and 32 are cylindrical, and the both ends 41 and 42 of the elastic member 40 which are engaged with the first and second fixing portions 22 and 32, respectively, are circular ring-shaped. Therefore, when the connector 20 pivots with respect to the razor handle 30, interference does not occur between the both ends 41 and 42 of the elastic member 40 and the first and second fixing portions 22 and 32.

Figure 3A:
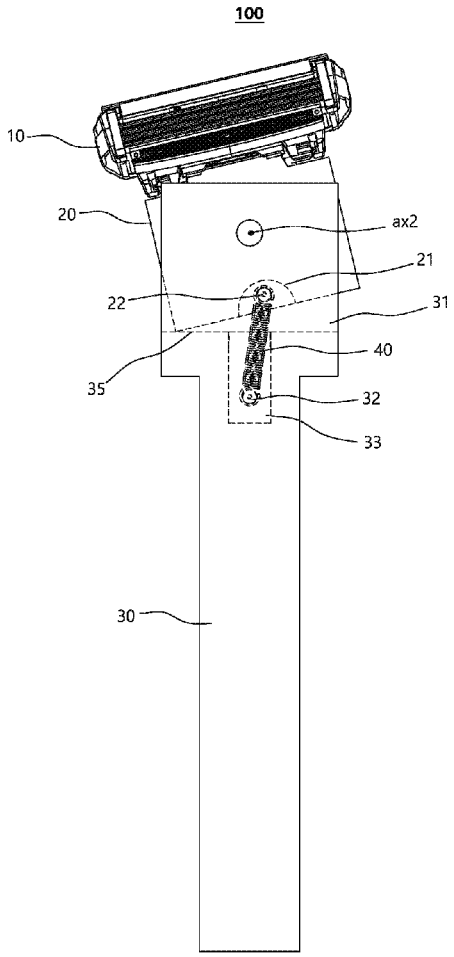
FIG. 3A is a plan view of the razor assembly when the connector is in a pivotal position.
Figure 3B:
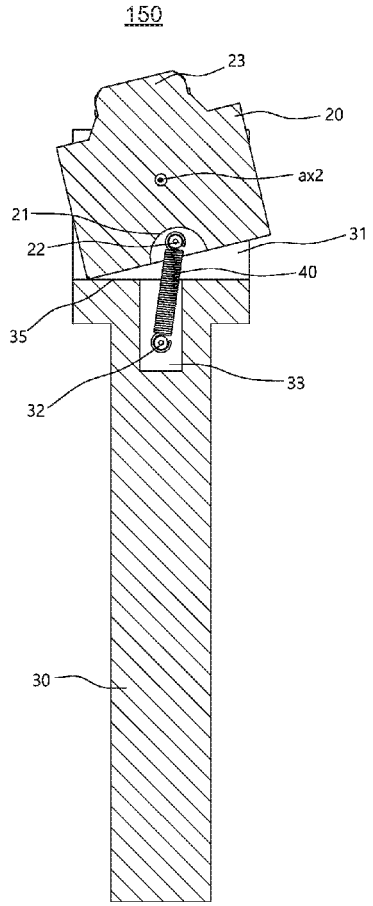
FIG. 3B is a longitudinal sectional view of a handle assembly obtained by removing a blade housing from FIG. 3A and taken along the longitudinal direction of the razor handle.

FIG. 3A is a plan view showing the razor assembly 100 when the connector 20 pivots with respect to the razor handle 30 (pivotal position). FIG. 3B is a longitudinal sectional view of a handle assembly 150 obtained by removing the blade housing 10 from FIG. 3A and taken along the longitudinal direction d2 of the razor handle 30.

In the pivotal position, the elastic member 40 is extended to provide a restoring force that causes the connector 20 to return to a neutral position (in which the connector 20 and the razor handle 30 are aligned). For stable operation, the elastic member 40 may be in a pre-tension state, that is, may be extended by an initial value even when the connector 20 is in the neutral position.

The razor handle is provided with a stopper 35 which contacts a side of the connector 20 when the connector 20 pivots more than a predetermined angle in order to prevent deviation of the connector 20 from a limited pivot range from the second (rotation) axis ax2 in the pivotal position. In FIGS. 3A and 3B, the stopper 35 is shown as a lower surface of the connector accommodating groove 31 that a corner of the connector 20 contacts in the pivotal position. However, the present disclosure is not limited to this case, and the stopper 35 may be any element that allows the connector 20 to pivot only within a predetermined range.

In addition, during the pivoting motion of the connector 20, there should be no contact or interference between the elastic member accommodating groove 21 and the elastic member 40. Therefore, the elastic member accommodating groove 21 may be formed in a substantially semicircular shape so as to have a wide opening toward the razor handle 30 when viewed from the front of the razor handle 30.

Figure 4:
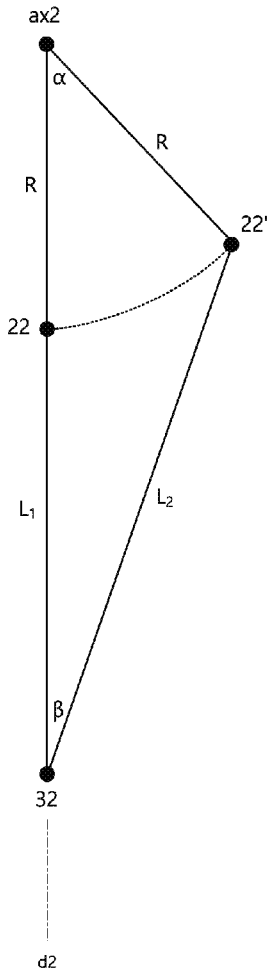
FIG. 4 is a schematic diagram showing the positional relationship between a second axis, a first fixing portion, and a second fixing portion in a neutral position and the pivotal position.

FIG. 4 is a schematic diagram showing the positional relationship between the second axis ax2, the first fixing portion 22, and the second fixing portion 32 in the neutral position and the pivotal position. In the neutral position, the second (rotation) axis ax2, the first fixing portion 22 and the second fixing portion 32 are arranged in a line along the longitudinal direction d2 of the razor handle 30, and the second axis ax2 is located closer to the blade housing 10 than the first and second fixing portions 22 and 32. Here, the length of the elastic member 40 before being deformed is $L_1$.

In the pivotal position, the first fixing portion 22 moves to a position indicated by reference character 22' while maintaining a distance R from the second axis ax2. Accordingly, the elastic member 40 is extended from $L_1$ to $L_2$. The extended displacement ($L_2-L_1$) of the elastic member 40 and an elastic modulus k of the elastic member 40 are factors that determine the restoring force of the connector 20. Ultimately, a design restoring force may be determined by assuming an angle α at which the first fixing portion 22 pivots about the second axis ax2 in the pivotal position.

Equations (1) and (2) below are satisfied by the geometric relationship shown in FIG. 4.

$$R\cos(\alpha)+L_2\cos(\beta)=R+L_1, \quad (1)$$

$$(R+L_1)^2=R^2+L_2^2+2RL_2\cos(\alpha+\beta) \quad (2).$$

Here, Equation (2) may be rearranged into Equation (3) for obtaining $L_2$.

$$L_2=\sqrt{R^2\cos^2(\alpha+\beta)+L_1^2+2RL_1}-R\cos(\alpha+\beta) \quad (3).$$

If Equation (1) is applied to Equation (3), $L_2$ is calculated as a function of α, R and $L_1$. Here, a design restoring force F is given by Equation (4), where k is the elastic modulus of the elastic member 40.

$$F=k(L_2-L_1) \quad (4).$$

Figure 5A:
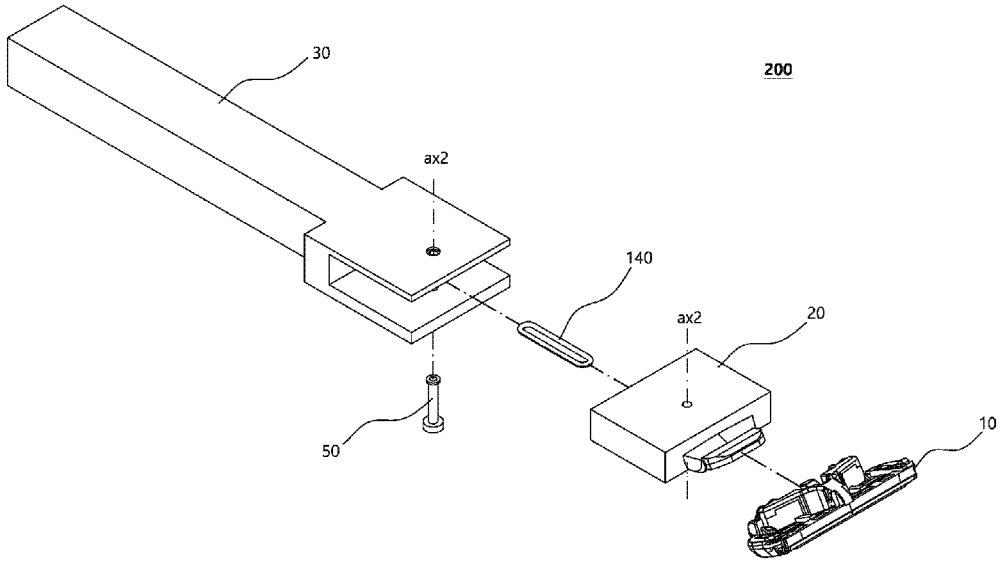
FIG. 5A is an exploded perspective view of a razor assembly according to a modified embodiment of the first embodiment.
Figure 5B:
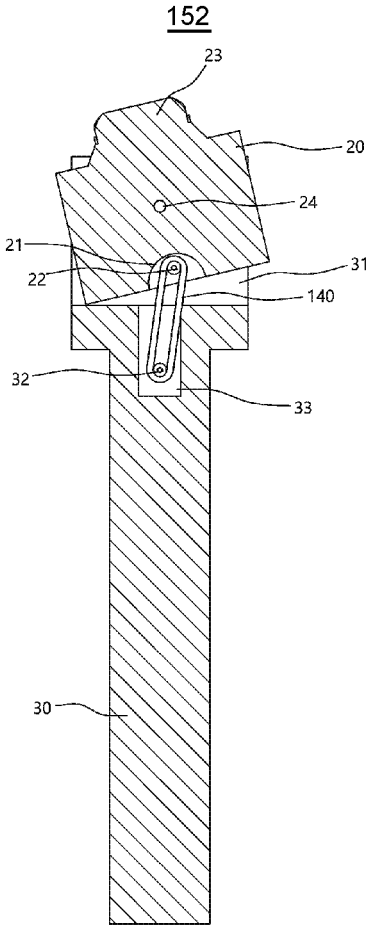
FIG. 5B is a longitudinal sectional view of a razor handle assembly obtained by removing a blade housing from the razor assembly.

FIGS. 5A and 5B show a modified embodiment using an O-ring 140 as an elastic member, instead of the coil spring 40. Specifically, FIG. 5A is an exploded perspective view of a razor assembly 200 according to a modified embodiment, and FIG. 5B is a longitudinal sectional view of a razor handle assembly 152 obtained by removing a blade housing 10 from the razor assembly 200.

The blade housing 10, a connector 20, and a razor handle 30 are the same as those described above, except that the O-ring 140 is used instead of the coil spring 40. As shown in FIG. 5B, the O-ring 140 is also extended in the lengthwise direction in the pivotal position so as to provide a restoring force that causes the connector 20 to return to the neutral position. The O-ring 140 may have a somewhat smaller elastic restoring force than the coil spring 40, but has a simple structure and can provide a smoother pivoting motion than the coil spring 40 due to its damping effect. In addition to the coil spring 40 and the O-ring 140 described above, elastic members of various materials such as a plurality of coil springs and an elastic cable can be applied according to a designer's intention.

Until now, the razor assemblies 100 and 200 according to the first embodiment have been described. According to the first embodiment, as shown in FIG. 1A, the connector 20 pivots in the direction (ax2) perpendicular to both the transverse direction d1 in which the razor blade 5 is accommodated in the blade housing 10 and the longitudinal direction d2 of the razor handle 30. Hereinafter, razor assemblies 300 and 400 according to a second embodiment will be described. According to the second embodiment, a connector pivots in a direction (ax3) parallel to the longitudinal direction d2 of the razor handle 30.

Figure 6A:
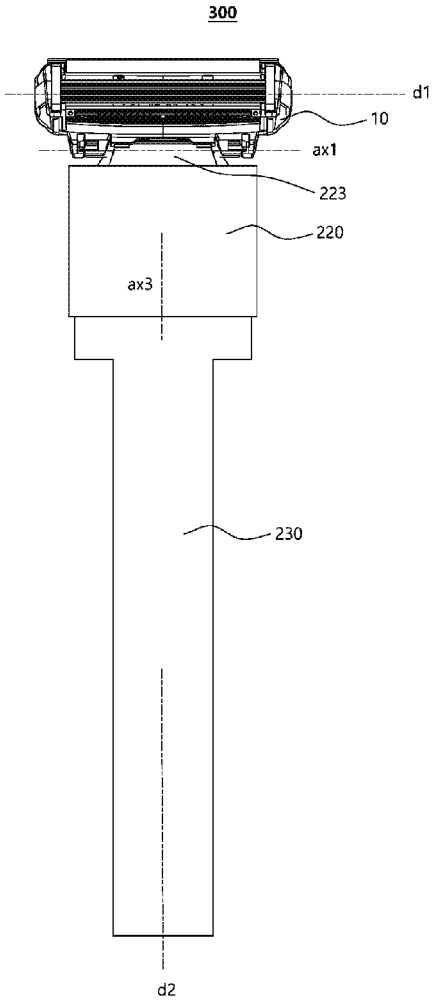
FIG. 6A is a plan view of a razor assembly according to a second embodiment as viewed from the front of a razor handle.
Figure 6B:
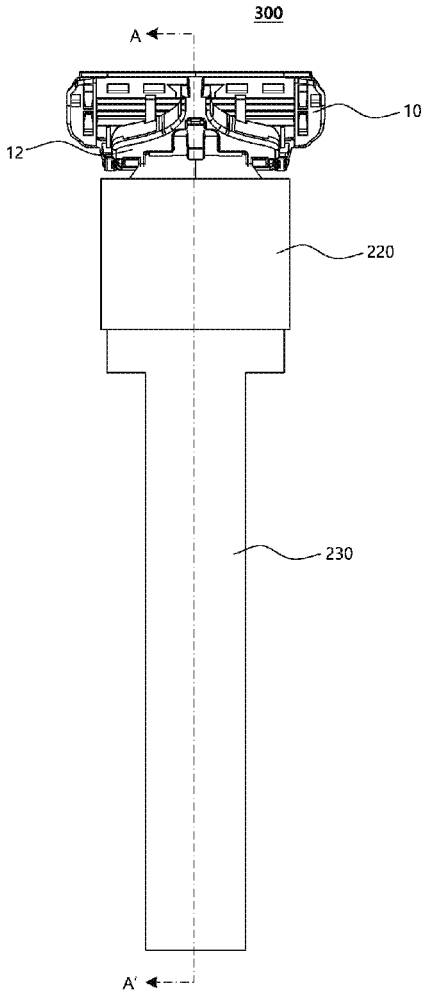
FIG. 6B is a plan view of the razor assembly of FIG. 6A as viewed from the back of the razor handle.
Figure 6C:
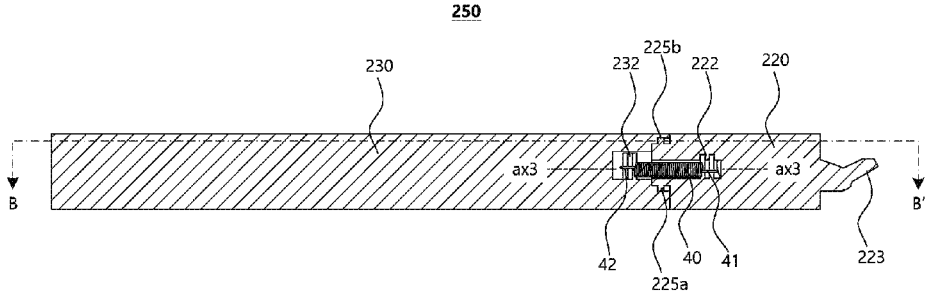
FIG. 6C is a longitudinal sectional view of a handle assembly taken along line A-A' of FIG. 6B and obtained by removing a blade housing.

FIG. 6A is a plan view of a razor assembly 300 according to a second embodiment as viewed from the front of a razor handle 230 (where the front of a blade housing 10 is visible), FIG. 6B is a plan view of the razor assembly 300 as viewed from the back of the razor handle 230, and FIG. 6C is a longitudinal sectional view of a handle assembly 250 taken along line A-A' of FIG. 6B and obtained by removing the blade housing 10.

A connector 220 is detachably coupled to the blade housing 10 at the back 12 of the blade housing 10. Here, the blade housing 10 may pivot about a first axis ax1 parallel to a transverse direction d1, in which a razor blade 5 is accommodated, with respect to the connector 220. Alternatively, the blade housing 10 may be fixed to a connection portion 223 of the connector 220, and the connection portion 223 may pivot about the first axis ax1 with respect to a body of the connector 220.

The connector 220 may pivot about a rotation axis, that is, a third axis ax3 perpendicular to the transverse direction d1 and parallel to a longitudinal direction d2 of the razor handle 230. To this end, as shown in FIG. 6C, both ends 41 and 42 of an elastic member 40 are engaged with a first fixing portion 222 of the connector 220 and a second fixing portion 232 of the razor handle 230, respectively. Therefore, a restoring force is provided when the connector 220 pivots about the third axis ax3 with respect to the razor handle 230 (pivotal position). This restoring force is provided by the torsion of the elastic member 40 about an axis parallel to a lengthwise direction, that is, the third axis ax3 in the pivotal position. The elastic member 40 may be embodied as, for example, a coil spring.

The pivoting of the connector 220 about the third axis ax3 may be guided by the movement of guide protrusions 225*a* and 225*b* formed on the connector 220 in guide slots 234*a* and 234*b* (see FIG. 7C) formed in the razor handle 230.

Figure 7A:
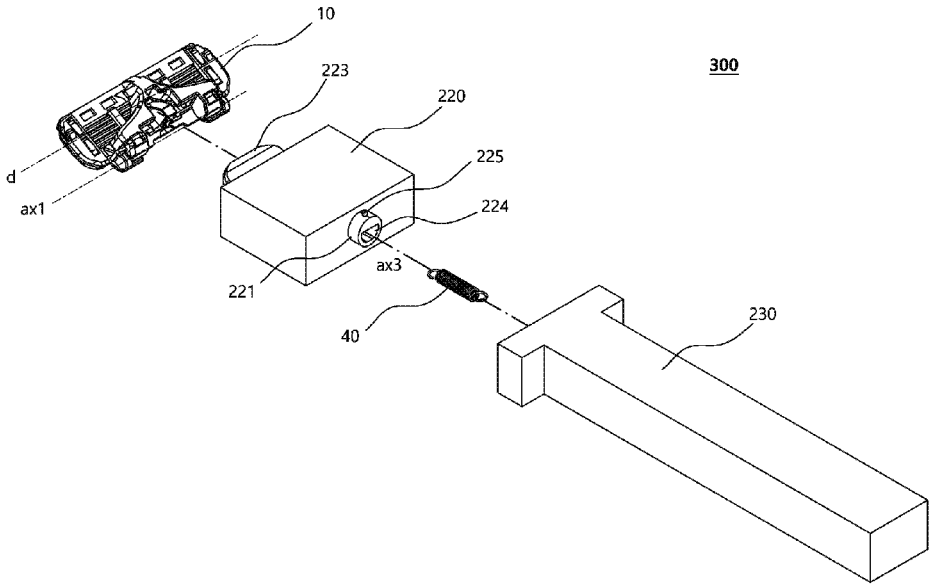
FIGS. 7A and 7B are exploded perspective views of the razor assembly of FIG. 6A as viewed from different directions.
Figure 7B:
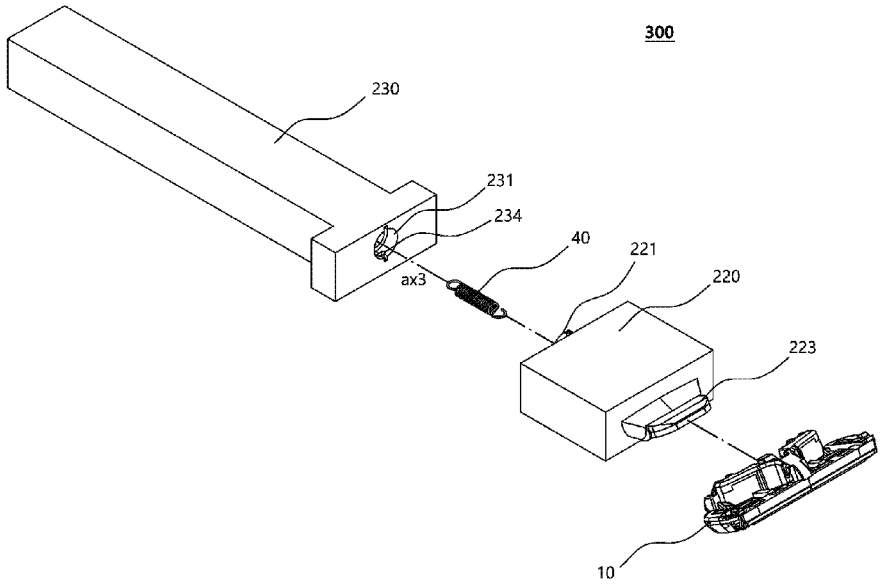
Figure 7C:
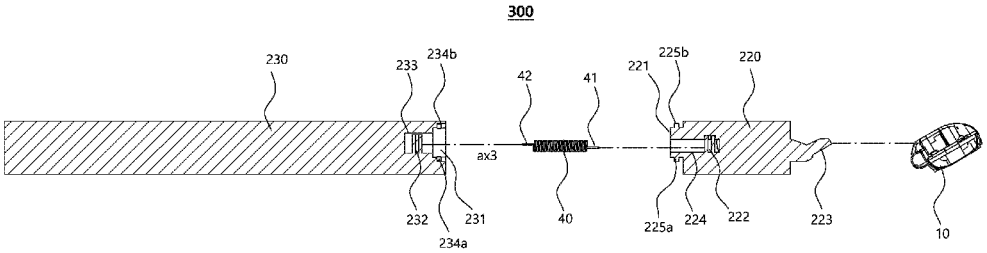
FIG. 7C is a longitudinal sectional view of the razor assembly taken along the longitudinal direction.

FIGS. 7A and 7B are exploded perspective views of the razor assembly 300 of FIG. 6A as viewed from different directions, and FIG. 7C is a longitudinal sectional view of the razor assembly 300 taken along the longitudinal direction.

Referring to FIGS. 7A through 7C, the coupling of the connector 220 and the razor handle 230 is basically accomplished as the guide protrusions 225 (225*a* and 225*b*) formed on an outer circumferential surface of an extension shaft 221 of the connector 220 are rotatably coupled to the guide slots 234 (234*a* and 234*b*) formed in a circumferential direction in an inner circumferential surface of an insertion groove 231 of the razor handle 230. However, in order to bring about the same effect in an opposite structure, the extension shaft 221 can be formed on the razor handle 230, and the insertion groove 231 can be formed in the connector 220.

The connector 220 includes a hollow portion 224 extending inward from the extension shaft 221 along the direction of the third axis ax3. A first fixing portion 222 is provided near an inner end of the hollow portion 224, and the end 41 of the elastic member 40 is engaged with the first fixing portion 222. Likewise, the razor handle 230 includes the insertion groove 231 extending inward along the direction of the third axis ax3. In addition, a second fixing portion 232 is provided in a hollow portion 233 extending inward from the insertion groove 231, and the other end 42 of the elastic member 40 is engaged with the second fixing portion 232.

For example, the first and second fixed ends 222 and 232 are cylindrical, and the both ends 41 and 42 of the elastic member 40 which are engaged with the first and second fixing portions 222 and 232, respectively, are circular ring-shaped. Therefore, when the connector 220 pivots with respect to the razor handle 230, interference does not occur between the both ends 41 and 42 of the elastic member 40 and the first and second fixing portions 222 and 232.

Figure 8A:
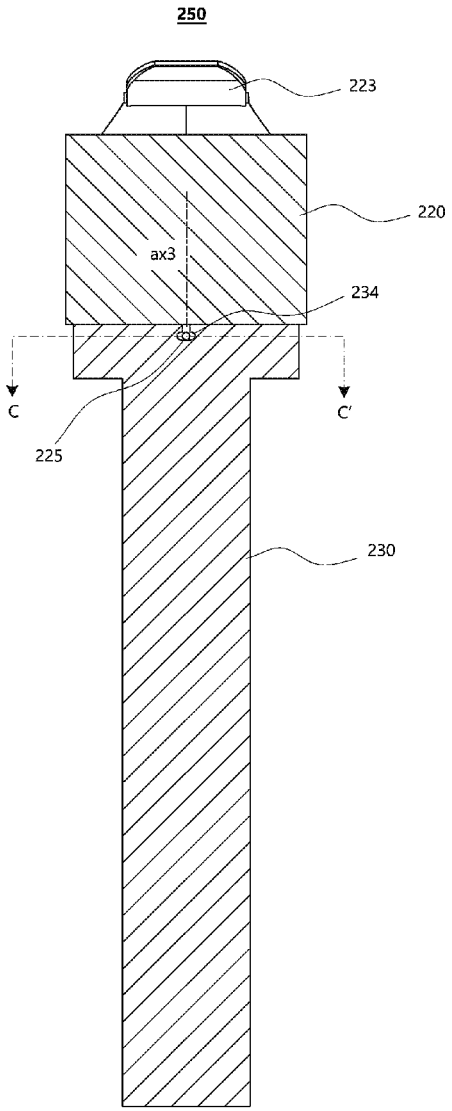
FIG. 8A is a longitudinal sectional view of the handle assembly taken along line B-B' of FIG. 6C.
Figure 8B:
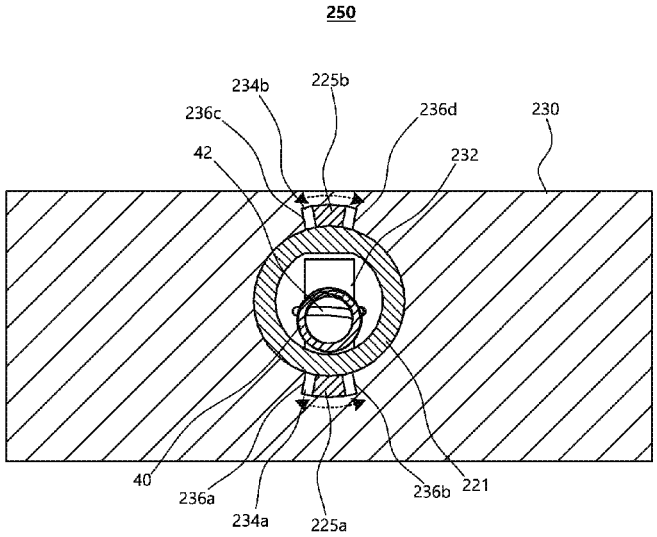
FIG. 8B is a cross-sectional view of the handle assembly en along line C-C' of FIG. 8A.

FIG. 8A is a longitudinal sectional view of the handle assembly 250 taken along line B-B' of FIG. 6C, and FIG. 8B is a cross-sectional view of the handle assembly 250 taken along line C-C' of FIG. 8A. Referring to FIG. 8B, when the connector 220 pivots more than a predetermined angle about the third axis ax3 (in the pivotal position), the guide protrusions 225*a* and 225*b* get caught on both sidewalk 236*a*, 236*b*, 236*c* and 236*d* of the guide slots 234*a* and 234*b*, thereby limiting the pivot range of the connector 220. In the pivotal position, the elastic member 40 is torsionally deformed about the third axis ax3, and the torsional deformation provides a restoring force that causes the elastic member 40 to return to the original neutral position. In addition, for stable operation, the elastic member 40 may be in a pre-tension state even when the connector 220 is in the neutral position.

Figure 9A:
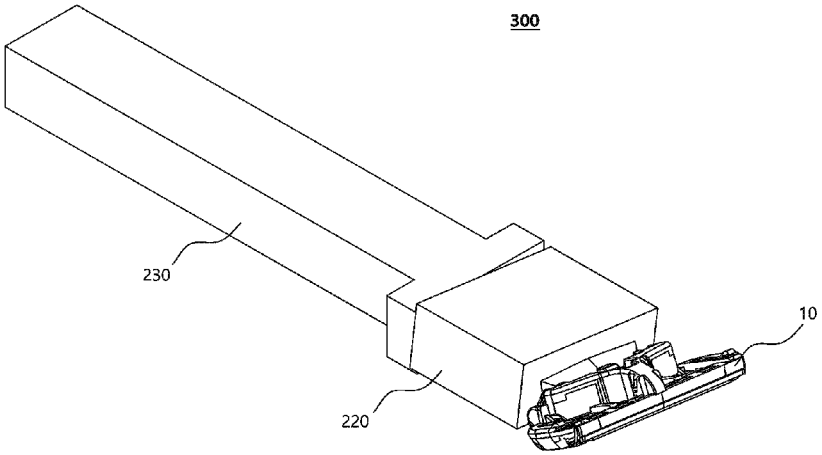
FIG. 9A is a perspective view of the razor assembly when a connector is in the pivotal position.
Figure 9B:
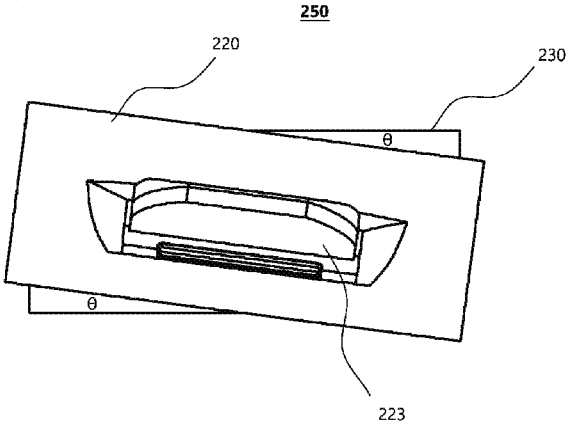
FIG. 9B is a plan view of the handle assembly obtained by removing the blade housing from the razor assembly and viewed from the side of a connection portion of the connector.

FIG. 9A is a perspective view of the razor assembly 300 when the connector 220 is in the pivotal position, and FIG. 9B is a plan view of the handle assembly 250 obtained by removing the blade housing 10 from the razor assembly 300 and viewed from the side of the connection portion 223 of the connector 220. In this pivotal position, a pair of guide protrusions 225*a* and 225*b* of FIG. 8B respectively get caught on the sidewalk 236*a* and 236*d* of the guide slots 234*a* and 234*b*, thereby limiting a pivot range θ (see FIG. 9B). Likewise, in the pivotal position in the opposite direction, the guide protrusions 225*a* and 225*b* respectively get caught on the sidewalk 236*b* and 236*c* of the guide slots 234*a* and 234*b*, thereby limiting the pivot range θ on the opposite side.

Figure 10A:
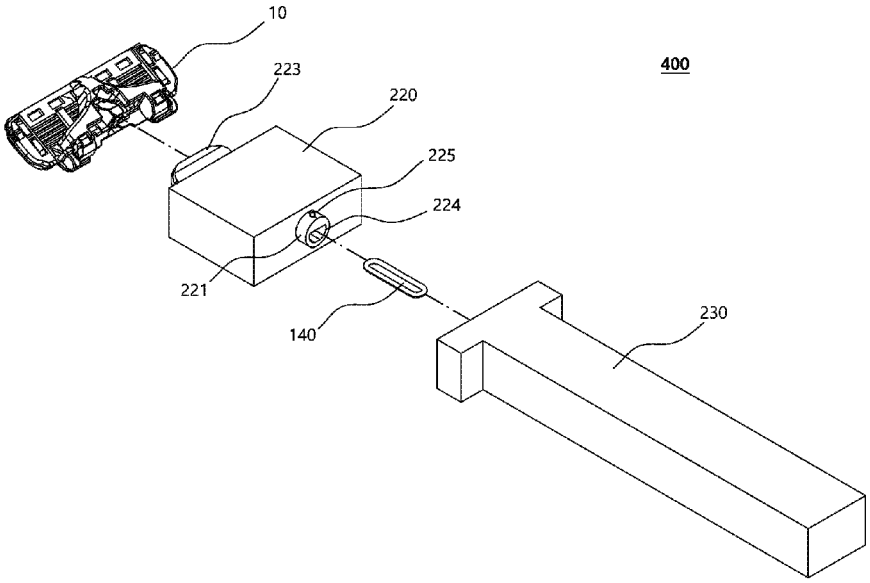
FIG. 10A is an exploded perspective view of a razor assembly according to a modified embodiment of the second embodiment.
Figure 10B:
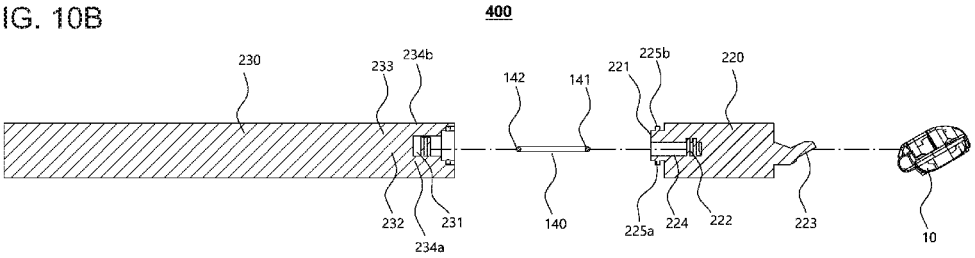
FIG. 10B is a longitudinal sectional view of the razor assembly according to the modified embodiment of the second embodiment.

FIGS. 10A and 10B show a modified embodiment using an O-ring 140 as an elastic member, instead of the coil spring 40. Specifically, FIG. 10A is an exploded perspective view of a razor assembly 400 according to a modified embodiment, and FIG. 10B is a longitudinal sectional view of the razor assembly 400.

A blade housing 10, a connector 220, and a razor handle 230 are the same as those described above, except that the O-ring 140 is used instead of the coil spring 40. As shown in FIG. 10B, the O-ring 140 is also twisted in the pivotal position so as to provide a restoring force that causes the connector 220 to return to the neutral position. The O-ring 140 may have a somewhat smaller elastic restoring force than the coil spring 40, but has a simple structure and can provide a smoother pivoting motion than the coil spring 40 due to its damping effect. In addition to the coil spring 40 and the O-ring 140 described above, elastic members of various materials such as a plurality of coil springs and an elastic cable can be applied according to a designer's intention.

A razor assembly according to the present disclosure can reliably and stably provide a pivoting motion about a second axis perpendicular to a first axis that is parallel to the alignment direction of one or more razor blades.

In addition, the razor assembly according to the present disclosure realizes a pivoting motion about the second axis through extension or torsion of an elastic member itself. Thus, the razor assembly is structurally simple and is less likely to be deformed even when used for a long time.

In addition, the razor assembly according to the present disclosure can improve shaving performance because the razor blades are brought into close contact with the profile of a user's skin during shaving.

However, the effects of the embodiments are not restricted to the one set forth herein. The above and other effects of the embodiments will become more apparent to one of daily skill in the art to which the embodiments pertain by referencing the claims.

While the present disclosure has been particularly shown and described with reference to exemplary embodiments thereof, it will be understood by those of ordinary skill in the art that various changes in form and detail may be made therein without departing from the spirit and scope of the present disclosure as defined by the following claims. The exemplary embodiments should be considered in a descriptive sense only and not for purposes of limitation.

What is claimed is:

1. A razor assembly comprising:

at least one razor blade, the at least one razor blade having an elongated cutting edge defining a transverse axis;

a housing which accommodates the at least one razor blade;

a connector which is detachably coupled to the housing at a back side of the housing;

a razor handle which is elongated to define a longitudinal axis and coupled to the connector such that the connector is capable of pivoting about a rotation axis penetrating the connector and razor handle and that is perpendicular to both the longitudinal axis and the transverse axis, the transverse axis being perpendicular to the longitudinal axis; and an elastic member having a first end engaged with a first fixing portion formed in the connector and a second end engaged with a second fixing portion formed in the razor handle, wherein when the connector pivots about the rotation axis with respect to the razor handle such that the transverse axis is no longer perpendicular to the longitudinal axis, the elastic member is deformed to provide a restoring force that causes the connector to return to a neutral position at which the transverse axis is perpendicular to the longitudinal axis.

2. The razor assembly of claim 1, wherein the elastic member is linearly deformed to elongate in a direction opposite to a direction to which the connector is moved when the connector pivots about the rotation axis with respect to the razor handle.

3. The razor assembly of claim 2, wherein the razor handle comprises an accommodating groove configured to receive at least a part of each of front and rear surfaces of the connector.

4. The razor assembly of claim 3, further comprising a fastener inserted into a through hole of the connector and through holes of the razor handle formed along the rotation axis to achieve the coupling between the razor handle and the connector, wherein the connector pivots about the fastener with respect to the razor handle.

5. The razor assembly of claim 4, wherein when the connector is in the neutral position, the rotation axis, the first fixing portion and the second fixing portion are aligned on the longitudinal axis, and the rotation axis is located closer to the housing than the first and second fixing portions.

6. The razor assembly of claim 2, wherein when the connector is in the neutral position, the elastic member is in a pre-tension state.

7. The razor assembly of claim 2, wherein the elastic member comprises at least one coil spring, an O-ring, or an elastic cable.

8. The razor assembly of claim 2, wherein:

a portion of the razor handle is configured to function as a stopper which contacts a side of the connector when the connector pivots more than a predetermined angle; and the stopper is configured to prevent deviation of the connector from a limited pivot range from the rotation axis.

9. A razor handle assembly comprising:

a connector which is detachably coupled to a razor cartridge at a back side of the razor cartridge, the razor cartridge is elongated to define a transverse axis;

a razor handle which is elongated to define a longitudinal axis and coupled to the connector such that the connector is capable of pivoting about a rotation axis penetrating the connector and razor handle and that is perpendicular to both the longitudinal axis and the transverse axis, the transverse axis being perpendicular to the longitudinal axis; and an elastic member having a first end engaged with a first fixing portion formed in the connector and a second end engaged with a second fixing portion formed in the razor handle, wherein when the connector pivots about the rotation axis with respect to the razor handle such that the transverse axis is no longer perpendicular to the longitudinal axis, the elastic member is deformed to provide a restoring force that causes the connector to return to a neutral position at which the transverse axis is perpendicular to the longitudinal axis.

* * * * *